US009806468B2

(12) United States Patent
Liao

(10) Patent No.: US 9,806,468 B2
(45) Date of Patent: Oct. 31, 2017

(54) CABLE CONNECTOR WITH WAFER STRUCTURE THEREOF

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/368,707

(22) Filed: Dec. 5, 2016

(65) Prior Publication Data

US 2017/0162984 A1 Jun. 8, 2017

(30) Foreign Application Priority Data

Dec. 4, 2015 (CN) ..... 2015 2 0991967 U

(51) Int. Cl.

| | |
|---|---|
| ***H01R 12/00*** | (2006.01) |
| ***H01R 13/6592*** | (2011.01) |
| ***H01R 13/405*** | (2006.01) |
| ***H01R 4/02*** | (2006.01) |
| ***H01R 12/72*** | (2011.01) |
| ***H01R 12/75*** | (2011.01) |

(52) U.S. Cl.

CPC ..... *H01R 13/6592* (2013.01); *H01R 4/023* (2013.01); *H01R 12/721* (2013.01); *H01R 12/75* (2013.01); *H01R 13/405* (2013.01)

(58) Field of Classification Search

CPC H01R 23/688; H01R 23/725; H01R 23/6873; H01R 23/7068; H01R 13/514; H01R 13/506; H05K 1/117

USPC ..... 439/60, 637, 607.05, 607.23, 607.47, 439/607.48

See application file for complete search history.

(56) References Cited

U.S. PATENT DOCUMENTS

| | | | | |
|---|---|---|---|---|
| 7,422,490 | B2 * | 9/2008 | Droesbeke | H01R 13/514 439/701 |
| 8,353,707 | B2 * | 1/2013 | Wang | H01R 13/6658 439/60 |
| 8,740,643 | B2 * | 6/2014 | Kuang | H01R 12/721 439/541.5 |
| 8,858,237 | B2 * | 10/2014 | Hsu | H01R 12/724 439/60 |

FOREIGN PATENT DOCUMENTS

| | | |
|---|---|---|
| TW | M393890 | 12/2010 |

* cited by examiner

*Primary Examiner* — Hien Vu

(74) *Attorney, Agent, or Firm* — Wei Te Chung; Ming Chieh Chang

(57) ABSTRACT

The cable connector includes a plurality of terminal wafers stacked with one another along a transverse direction, a metallic shell enclosing the terminal wafers, and a plurality of cables mechanically and electrically connected to the corresponding wafers. The terminal wafers include the grounding terminal wafers and the signal terminal wafers alternatively arranged with each other along the transverse direction. Each of the grounding terminal wafers or that of the signal terminal wafers includes a plate like insulator and the corresponding terminal(s) fixed therewithin.

12 Claims, 10 Drawing Sheets

CABLE CONNECTOR WITH WAFER STRUCTURE THEREOF

BACKGROUND OF THE INVENTION

1. Field of the Invention

The present invention relates to an electrical connector, and particularly to a cable connector. This application relates to the copending application Ser. No. 15/222,980 filed Jul. 29, 12016.

2. Description of Related Art

Taiwan M393890 issued on Dec. 1, 2010 discloses the cable connector including an insulative insulator with integrally formed terminals in two rows each extending along a transverse direction. Anyhow, such an electrical connector lacks flexibility of the numbers of the corresponding terminals/cables.

An improved electrical connector with flexibility of adjustment of the numbers of the corresponding terminal/cable, is desired.

SUMMARY OF THE INVENTION

Accordingly, the object of the present invention is to provide an electrical cable connector with flexibility of adjustment of the corresponding terminal/cable number. The cable connector includes a plurality of terminal wafers stacked with one another along a transverse direction, a metallic shell enclosing the terminal wafers, and a plurality of cables mechanically and electrically connected to the corresponding wafers. The terminal wafers include the grounding terminal wafers and the signal terminal wafers alternatively arranged with each other along the transverse direction. Each of the grounding terminal wafers or that of the signal terminal wafers includes a plate like insulator and the corresponding terminal(s) fixed therewithin. The insulator includes a main body and a pair of extensions forwardly extending from the main body. The pair of extensions form an opening wherein the openings of all the wafers are aligned with one another in the transverse direction so as to form a common receiving cavity of the whole cable connector. The terminal(s) of each terminal wafer has a fixed section embedded within the main body, and contacting sections exposed between the pair of corresponding extensions in a vertical direction perpendicular to the transverse direction.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
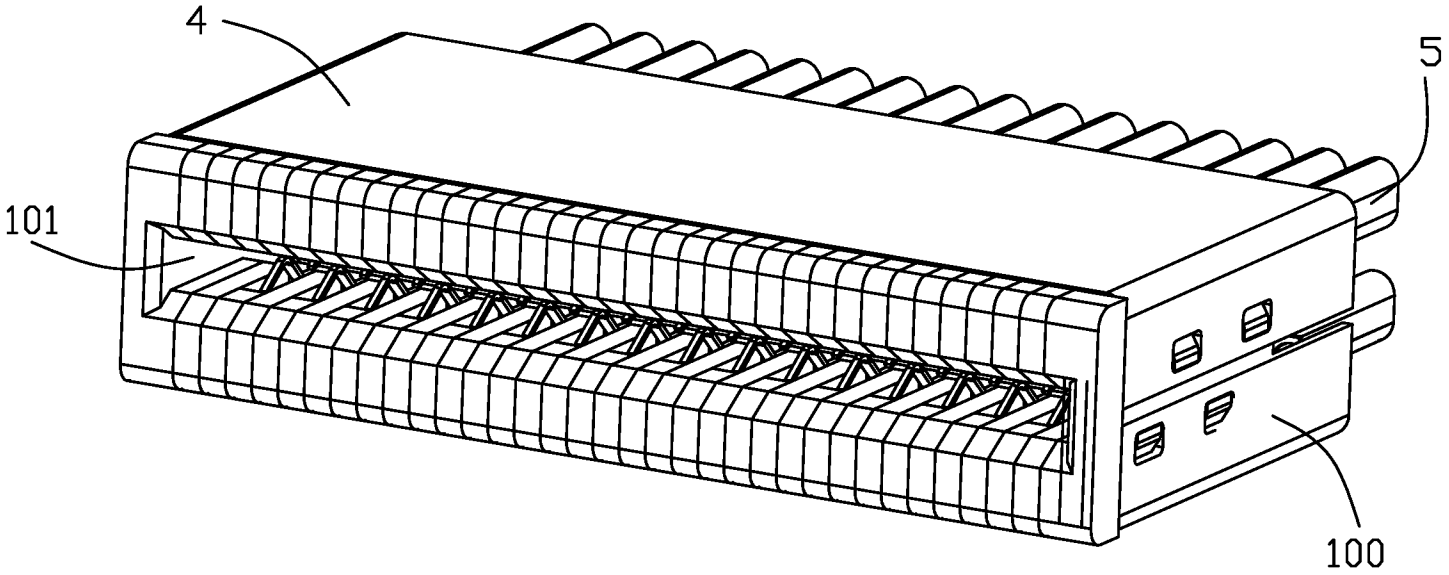
FIG. 1 is an assembled perspective view of an electrical connector according to the presently preferred embodiment of the invention.
Figure 2:
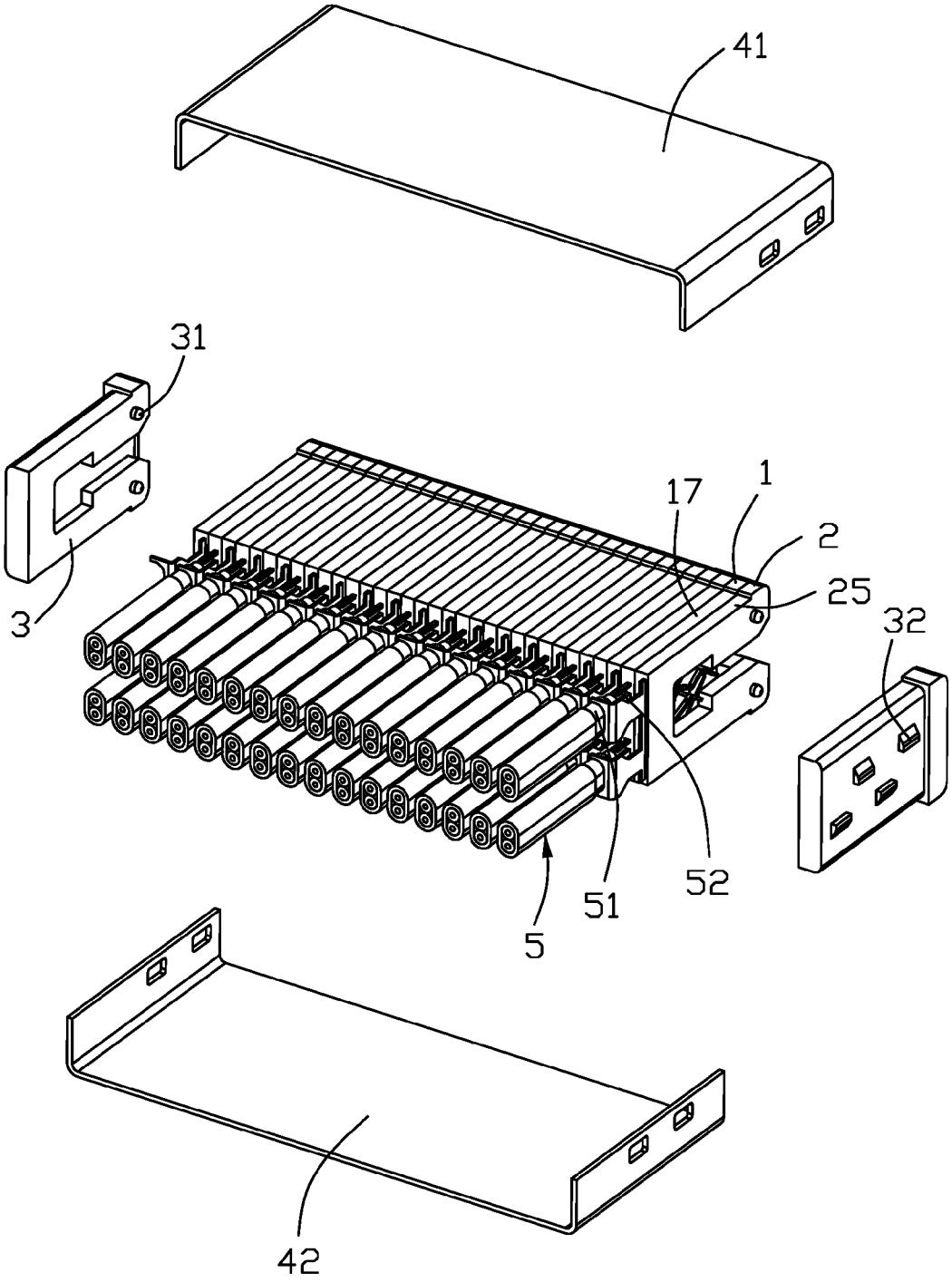
FIG. 2 is an exploded perspective view of the electrical connector FIG. 1.
Figure 3:
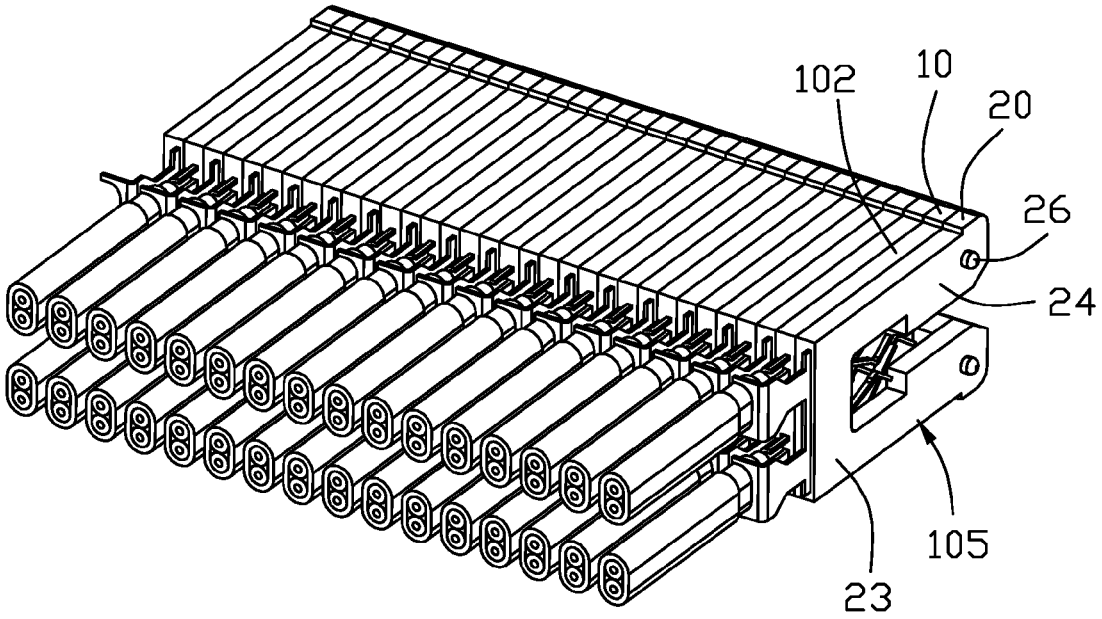
FIG. 3 is an assembled perspective view of the terminal wafer sub-assembly of the electrical connector of FIG. 2.
Figure 4A:
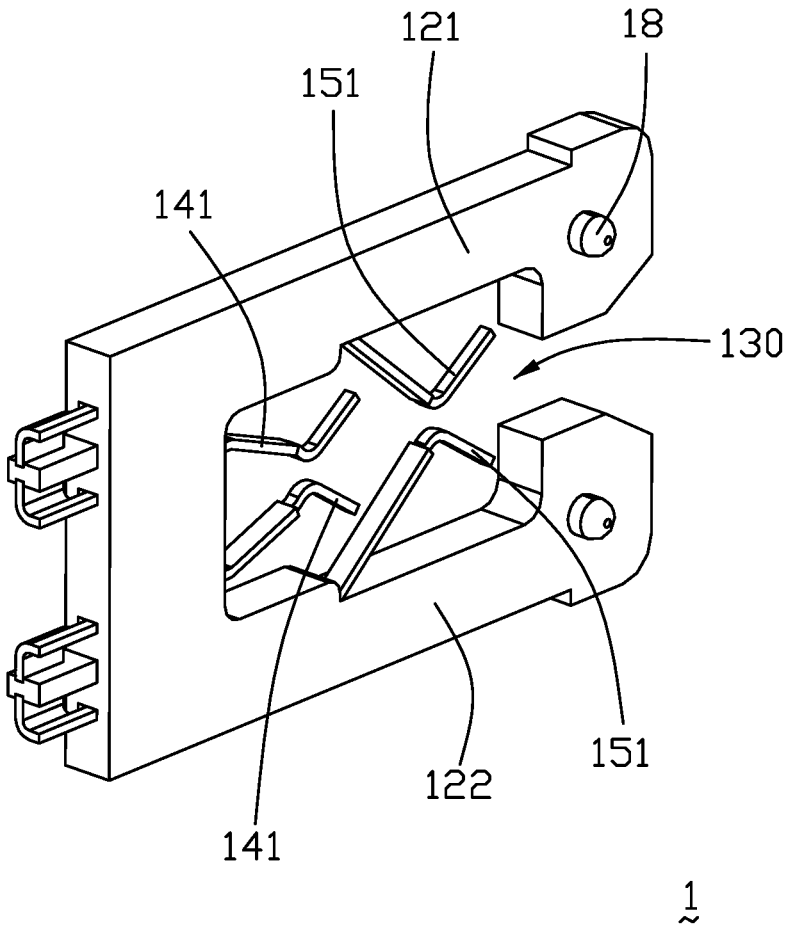
FIG. 4(A) is an assembled perspective view of a single signal terminal wafer of the electrical connector of FIG. 3.
Figure 4B:
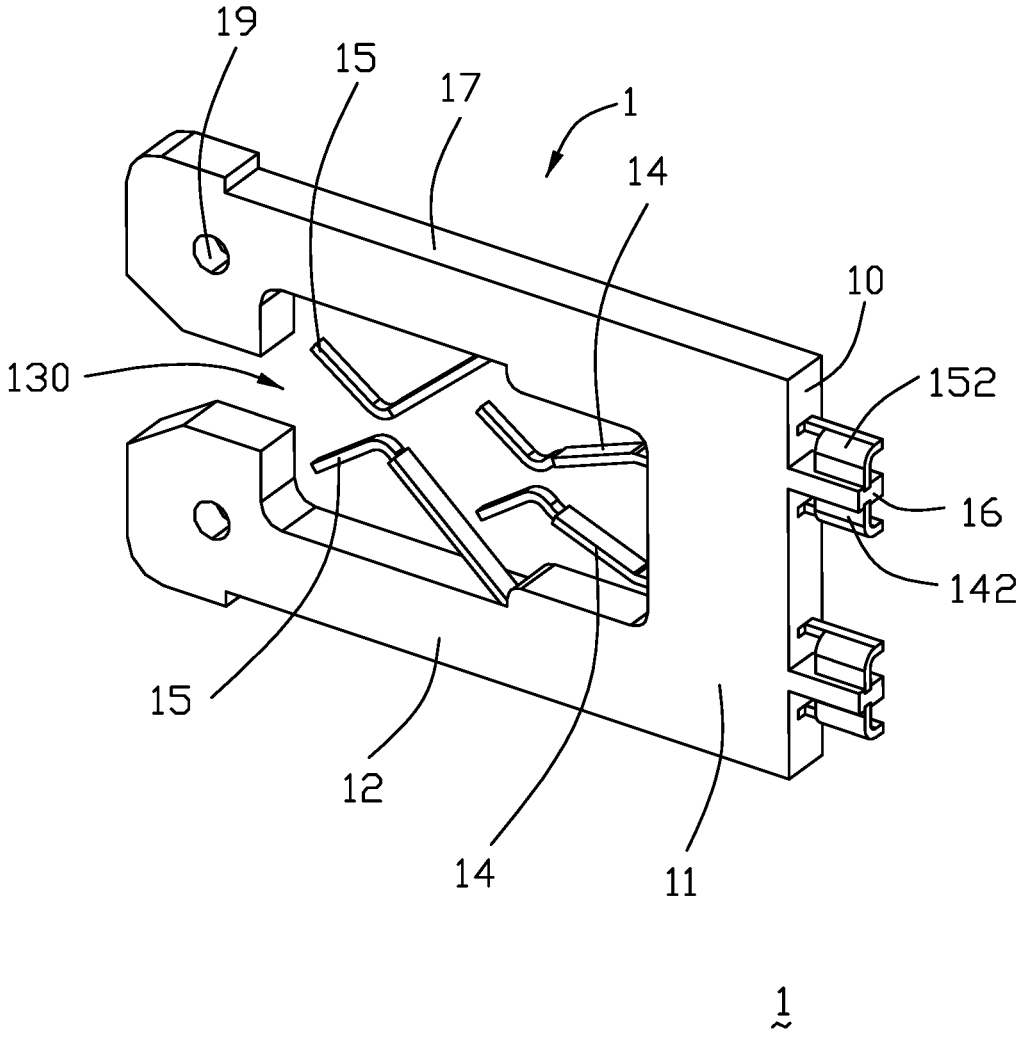
FIG. 4(B) is another assembled perspective view of the single signal terminal wafer of the electrical connector of FIG. 4(A)
Figure 5:
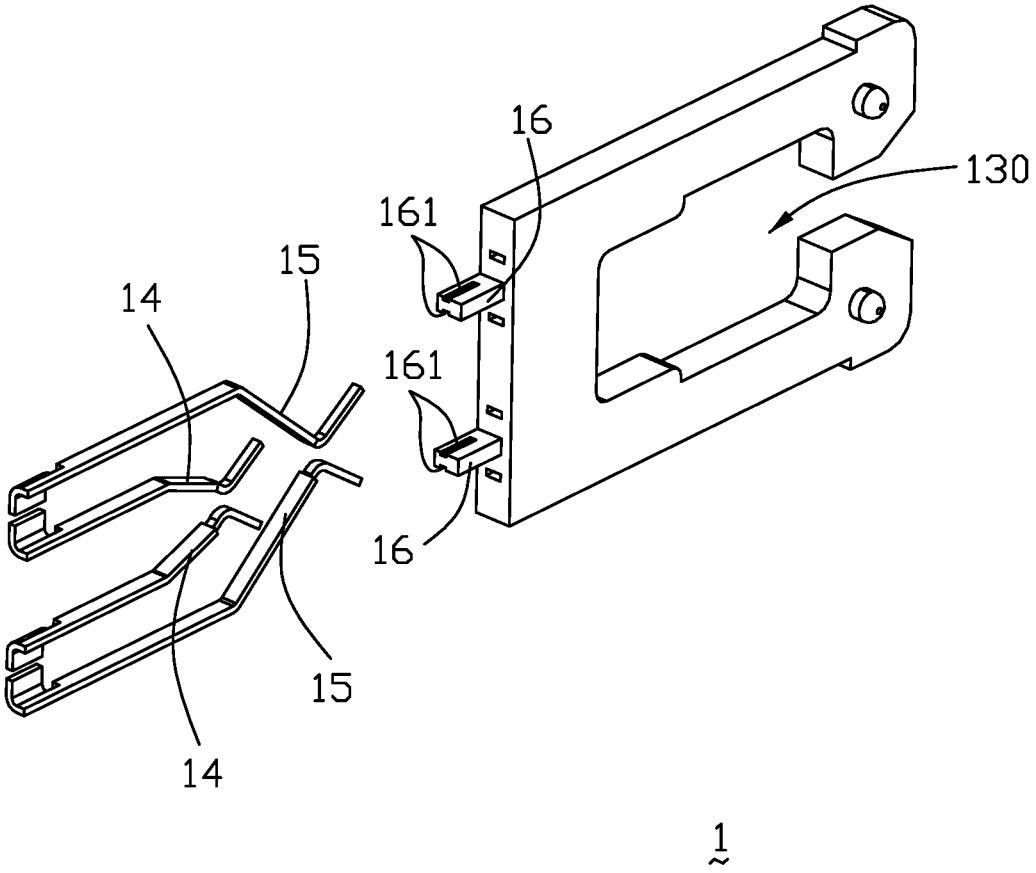
FIG. 5 is an exploded perspective view of the single signal terminal wafer of the electrical connector of FIG. 4(A)
Figure 6A:
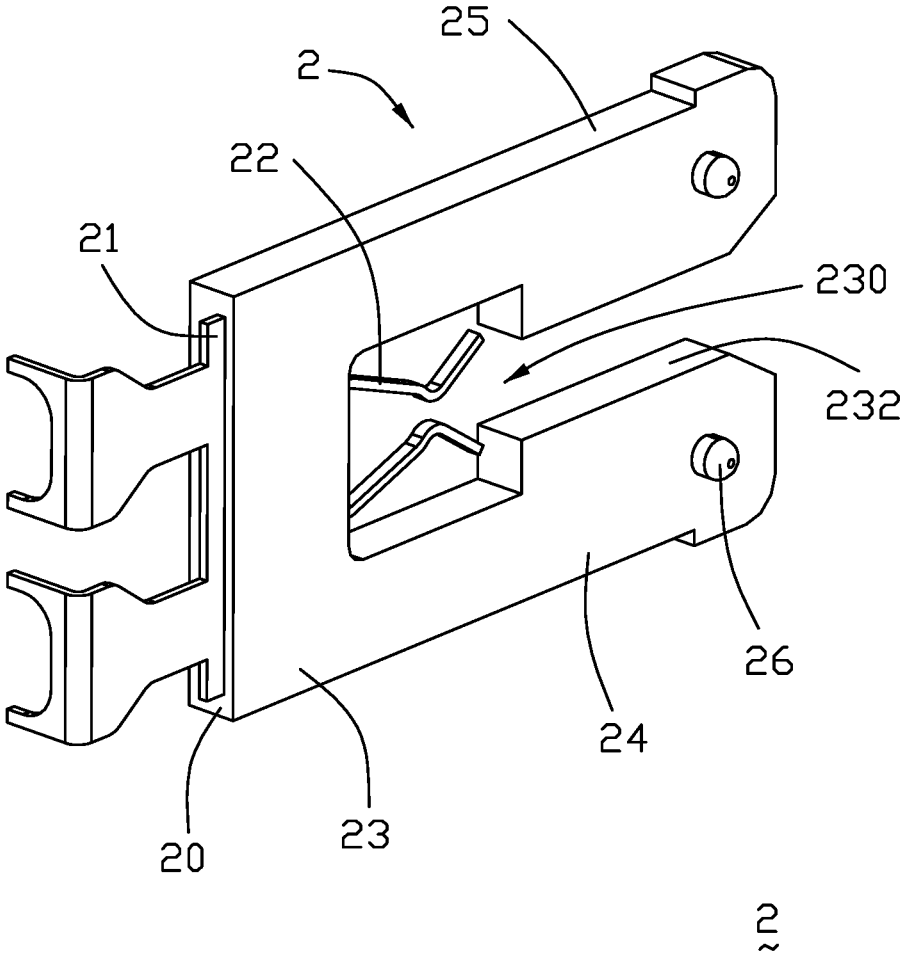
FIG. 6(A) is an assembled perspective view of the single grounding terminal wafer of the electrical connector of FIG. 3.
Figure 6B:
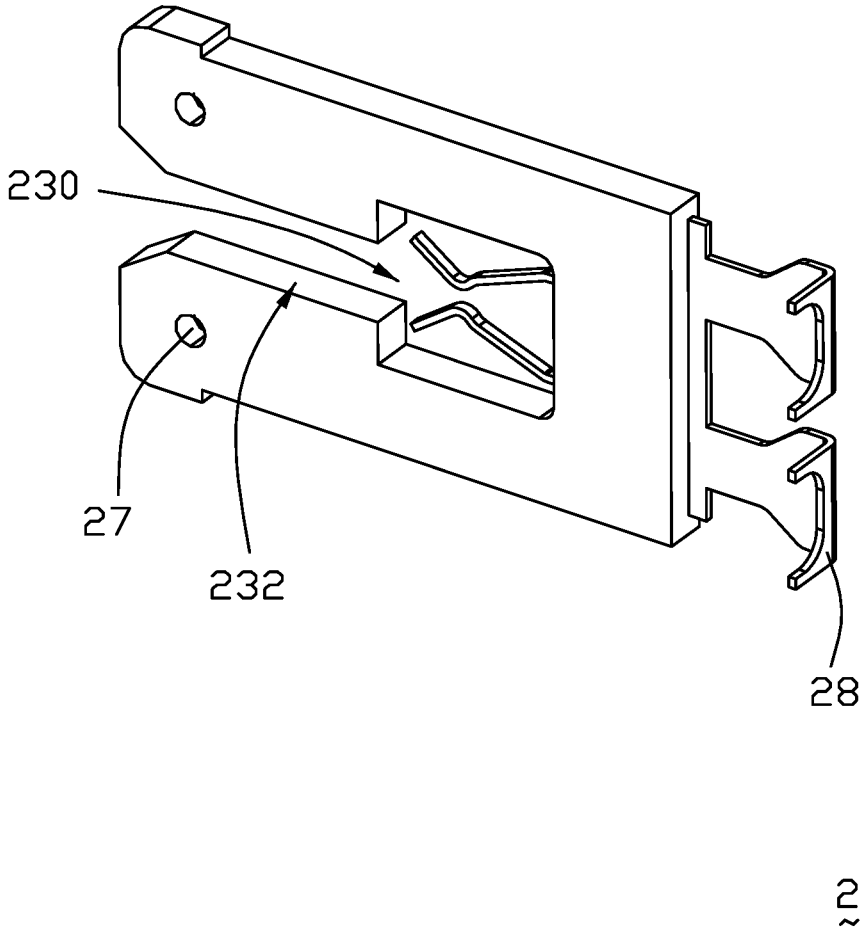
FIG. 6(B) is another assembled perspective view of the single grounding terminal wafer of the electrical connector of FIG. 6(A)
Figure 7:
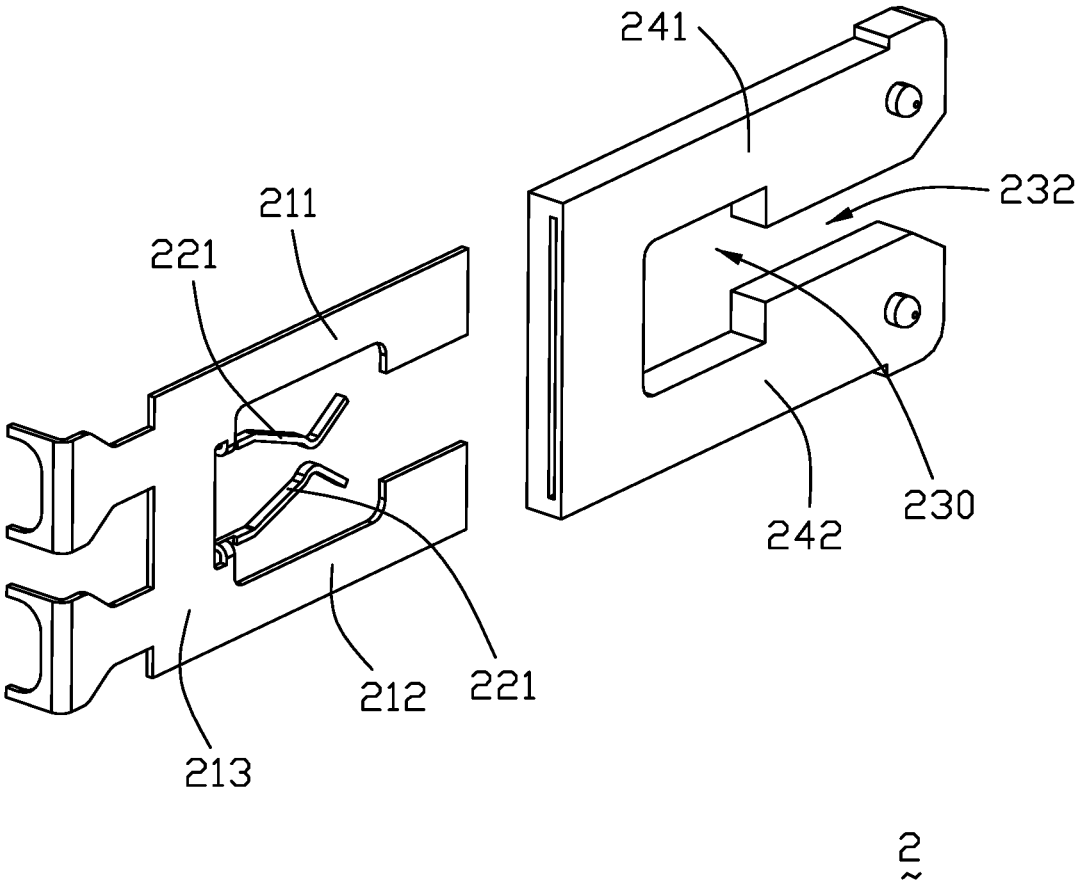
FIG. 7 is an exploded perspective view of the single grounding terminal wafer of the electrical connector of FIG. 6(A)
Figure 8:
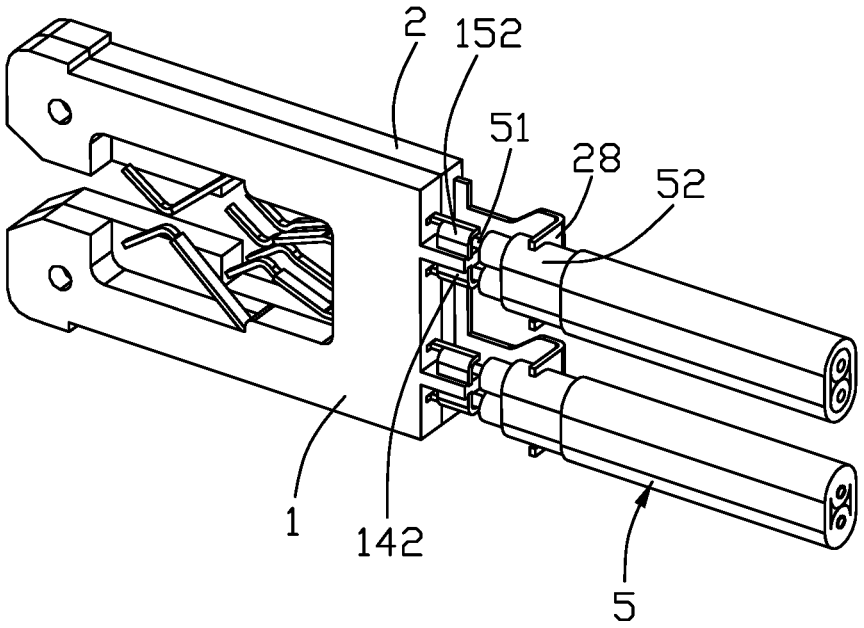
FIG. 8 is an assembled perspective view of the two adjacent terminal wafers of the terminal wafer sub-assembly of the electrical connector of FIG. 3.

Referring to FIGS. 1 to 8, an electrical connector 100 for mating with an edge (connector) of a daughter board, includes a wafer sub-assembly 105 essentially composed of a plurality of signal terminal wafers 1 and a plurality of grounding terminal wafers 2 alternately stacked with each other along a transverse direction, a pair of end wafers 3 located at two ends of the wafer sub-assembly 105 in the transverse direction, a metallic shell 4 enclosing the wafer sub-assembly 105 and the pair of end wafers, and a plurality of cables mechanically and electrically connected to the corresponding signal terminal wafers and 1 grounding terminal wafers 2. The end wafers 3 are used to electrically separate the metallic shell 4 from the wafer sub-assembly 105. Each end wafer 3 forms a first fixing part 31 on an inner side to secure to the neighboring signal/grounding terminal wafer 1/2, and a second fixing part 32 on an outer side to secure to the metallic shell 4. The metallic shell 4 includes an upper shell 41 and a lower shell 42 respective securing to the second fixing parts 32 of the corresponding end wafers 3 so as to indirectly secure the wafer sub-assembly 105 between the pair of end wafers 3. A plurality of differential pair cables 5 are mechanically and electrically connected to the wafer sub-assembly 105. Each cable 5 includes a pair of inner conductors 51 and an outer braiding 52. The whole connector 100 forms a receiving cavity 101 to receive the aforementioned corresponding edge. The wafer sub-assembly 105 is receive within the metallic shell 4.

Each signal terminal wafer 1 includes a plate like (signal) insulator 10 essentially composed of a main body 11 and a pair of extensions 12 forwardly extending from the main body 11. A fixing protrusion 18 and a fixing hole 19 are respectively formed on two opposite sides each insulator 10 for securing the neighboring grounding terminal wafers 2 continuously. An opening 130 is formed between the pair of extensions 12 which include an upper extension 121 and a lower extension 122. The signal terminals integrally formed within the insulator 10 via an insert-molding process, are arranged with an upper terminal set and a lower terminal set at two levels, and each of the upper terminal set and the lower terminal set includes a plurality of first/inner/rear terminals 14 and a plurality of second/outer/front terminals 15 wherein the first terminal 14 is secured to the main body 11 with a first contacting section 141 exposed in the opening 130, and the second terminal 15 is secured to the main body 11 with a second contacting section 151 exposed in the opening 130. The first contacting section 141 and the second contacting section 151 corresponding to the extension 12. The main body 11 of the signal terminal wafer 1 forms a supporting section 16 to supporting the first soldering leg 142 of the first terminal 14 and the second soldering leg 152 of the second terminal 15 which are mechanically and electrically connected to the inner conductors 51 of the corresponding cable 5. In this embodiment, the supporting section 16 forms corresponding slots 161 to receive the corresponding first The signal terminal wafer 1 forms a pair of cutouts 17 in opposite exterior surfaces for receiving the metallic shell 4.

Similarly, the grounding terminal wafer 2 includes a (grounding) insulator 20, a grounding terminal 22 including a shielding plate 21 embedded within the insulator 20 via an insert-molding process. The insulator 20 includes a main body 23 and a pair of extensions 24. The grounding terminal wafer 2 includes a fixing protrusion 26 and a fixing hole 27 for securing the neighboring signal terminal wafers 1 continuously. The pair of extensions 24 of the grounding terminal wafers 2 form an opening 230, and a pair of cutouts 25 in opposite surfaces thereof. The extension 24 include an upper extension 241 and a lower extension 242. The shielding plate 21 includes an upper section 211 embedded in the upper extension 241, a lower section 212 embedded in the lower extension 242, and a connecting section 213 embedded within the main body 23. A pair of contacting sections 221 extend from the shielding plate 21 into the corresponding opening 230 corresponding to the pair of extensions 24, and a pair of soldering legs 28 extend from the shielding plate 21 and are exposed rearwardly outside of the insulator 20 for securing to the braiding 52 of the corresponding cable 5. Similar to the cutouts 17, the cutouts 25 are used to receive the metallic shell 4. Notably, as mentioned before the signal terminals are arranged with the upper terminal set and the lower terminal set at two levels in a separate manner. Anyhow, for each grounding terminal 2, the upper section 211 and the lower section 212 are mechanically and electrically connected by the connecting section 213 in a one-piece manner. Notably, the alternately arranged opening 130 and openings 230 are used to commonly receive the card edge. In this embodiment, the opening 230 between the extensions 24 forms a narrowed front region 232 in aligned with the second contacting sections 151 in the transverse direction. This arrangement is to provide the inserted card edge (not shown) with superior retention for resisting vibration during mating.

However, the disclosure is illustrative only, changes may be made in detail, especially in matter of shape, size, and arrangement of sections within the principles of the invention.

What is claimed is:

1. An electrical connector comprising:

a wafer sub-assembly including:

a plurality of signal terminal wafers and a plurality of grounding terminal wafers alternately stacked with one another in a transverse direction;

each of said signal terminal wafers including a signal insulator and a plurality of signal terminals integrally formed therewith via an insert-molding process and arranged with an upper terminal set and a lower terminal set, the signal insulator including a first main body with an upper extension and a lower extension forwardly extending from the main body with therebetween a first opening, in a vertical direction perpendicular to said transverse direction, in which a pair of contacting sections of the corresponding two signal terminals extend; and each of said grounding terminal wafers including a grounding insulator and a shielding plate having a grounding terminal embedded therewith, the grounding insulator including a second main body with a pair of extensions forwardly extending from the second main body with therebetween a second opening in the vertical direction, in which a pair of contacting sections of the corresponding signal terminal extend, the first openings being aligned with the second openings in the transverse direction; and a plurality of cables each equipped with an inner conductor and an outer braiding respectively mechanically and electrically connected to the corresponding signal terminal and grounding terminal; wherein each of the cables is aligned with the corresponding signal terminal wafer in a front-to-back direction perpendicular to said transverse direction and said vertical direction while being offset from the corresponding grounding terminal wafer;

wherein the signal terminal includes a signal soldering leg on which the inner conductor of the corresponding cable is soldered, and the grounding terminal includes a grounding soldering leg on which the outer braiding of the corresponding cable is soldered, said signal soldering leg and said grounding soldering leg commonly define a transversely communicative common space in which both the soldering leg and said another soldering leg face to each other; and wherein the electrical connector further includes an upper metallic shell and a lower metallic shell to enclose said wafer sub-assembly.

2. The electrical connector as claimed in claim 1, wherein said another soldering leg of the grounding terminal extends toward the soldering leg of the signal terminal in the transverse direction.

3. The electrical connector as claimed in claim 1, wherein said grounding terminal includes a pair of grounding soldering legs respectively connected to different outer braidings of the different two cables.

4. The electrical connector as claimed in claim 1, further including a pair of end wafers located at two opposite ends of the wafer sub-assembly in said transverse direction.

5. The electrical connector as claimed in claim 1, wherein said signal insulator forms a fixing protrusion and a fixing hole on two opposite sides for securing to the neighboring grounding insulators by said two sides, and said grounding insulator forms another fixing protrusion and another fixing hole on two opposite faces for securing to the neighboring signal insulators by said two faces.

6. The electrical connector as claimed in claim 1, wherein the upper terminal set and the lower terminal set are respectively located in the upper extension and the lower extension, while the grounding terminal includes a shielding plate located in both the pair of extensions.

7. An electrical connector comprising:

a wafer sub-assembly including:

a plurality of signal terminal wafers and a plurality of grounding terminal wafers alternately stacked with one another along a transverse direction;

each of said signal terminal wafers including a signal insulator, and an outer signal terminal and an inner signal terminal integrally formed within the signal insulator via an insert-molding process, the signal insulator including a first main body with an upper extension and a lower extension forwardly extending from the first main body with a first opening therebetween in a vertical direction perpendicular to said transverse direction; each of said outer signal terminals including an outer contacting section extending into the first opening, and an outer soldering leg exposed outside of the signal insulator, each of said inner signal terminals including an inner contacting section extending into the first opening behind the outer contacting section of the outer signal terminal in a front-to-back direction perpendicular to both said transverse direction and said vertical direction, and an inner soldering leg exposed outside of the signal insulator;

each of said grounding terminal wafers including a grounding insulator, and a grounding terminal integrally formed within the grounding insulator via another insert-molding process, said grounding insulator including a second main body with a pair of extensions forwardly extending form the second main body with a second opening therebetween in the vertical direction, said grounding terminal including at least one contacting section exposed in the second opening, and a soldering leg exposed outside of the grounding insulator; and a plurality of differential pair cables each including a pair of inner conductors and an outer braiding; wherein the pair of inner conductors of each cable are mechanically and electrically connected to the soldering leg of the inner signal terminal and the soldering leg of the outer signal terminal of the corresponding signal terminal wafer, and the outer braiding is mechanically and electrically connected to the soldering leg of the grounding terminal of the grounding terminal wafer beside said signal terminal wafer;

wherein the grounding terminal includes a shielding plate extending in the corresponding grounding insulator and wherein the electrical connector further includes an upper metallic shell and a lower metallic shell to enclose said wafer sub-assembly.

8. The electrical connector as claimed in claim 7, wherein the second opening of the grounding terminal wafer forms a narrowed front region to comply with the outer contacting section of the outer signal terminal of the neighboring signal terminal wafer in the transverse direction.

9. The electrical connector as claimed in claim 7, wherein the cable is located behind and aligned with the corresponding signal terminal wafer in the front-to-back direction while being offset from the corresponding grounding terminal wafer in the transverse direction.

10. The electrical connector as claimed in claim 7, wherein in each signal terminal wafer, the inner soldering leg of the inner signal terminal is aligned with the outer soldering leg of the outer signal terminal in the vertical direction.

11. An electrical connector comprising:

a wafer sub-assembly including:

a plurality of signal terminal wafers and a plurality of grounding terminal wafers alternately arranged with each other along a transverse direction;

each of said signal terminal wafers including a signal insulator with a first main body and opposite upper and lower extensions extending forwardly from the first main body, an upper outer signal terminal and an upper inner signal terminal integrally formed with the signal insulator around the upper extension, a contacting section of the upper outer signal terminal being located in front of and in alignment with a contacting section of the upper inner signal terminal along a front-to-back direction perpendicular to said transverse direction, a soldering leg of the upper outer signal terminal being located above and aligned with a soldering leg of the upper inner signal terminal in a vertical direction perpendicular to both said transverse direction and said front-to-back direction, a lower outer signal terminal and a lower inner signal terminal integrally formed with the signal insulator around the lower extension, a contacting section of the lower outer signal terminal being located in front of and in alignment with a contacting section of the lower inner signal terminal in the front-to-back direction, a soldering leg of the outer lower signal terminal being located below and aligned with a soldering leg of the lower inner signal terminal in the vertical direction;

each of said grounding terminal wafer includes a grounding insulator with a second main body and pair of extensions extending forwardly from the second main body, a grounding terminal integrally formed within the grounding insulator and having a shielding plate embedded in the grounding insulator and having a pair of contacting sections corresponding to the contacting section of the upper inner signal terminal and that of the lower inner signal terminal, respectively, and an upper grounding leg located adjacent to the soldering legs of the upper inner and outer signal terminals, and a lower grounding leg locate adjacent to the soldering legs of the lower inner and outer signal terminals;

wherein the electrical connector further includes an upper metallic shell and a lower metallic shell to enclose said wafer sub-assembly.

12. The electrical connector as claimed in claim 11, further including a plurality of cables arranged in pairs in the vertical direction, wherein each pair of cables are respectively mechanically and electrically connected to the corresponding soldering legs of the upper outer and inner signal terminals, and the corresponding soldering legs of the lower outer and inner signal terminals.

* * * * *